US006897774B2

(12) United States Patent
Costa et al.

(10) Patent No.: US 6,897,774 B2
(45) Date of Patent: May 24, 2005

(54) AMBIENT CONDITION DETECTOR WITH MULTIPE SENSORS AND SINGLE CONTROL UNIT

(75) Inventors: Hilario Costa, Myakka City, FL (US); Robert Right, Holmes Beach, FL (US); Jeffery Burns, Bradenton, FL (US)

(73) Assignee: Edwards Systems Technology, Inc., Cheshire, CT (US)

( * ) Notice: Subject to any disclaimer, the term of this patent is extended or adjusted under 35 U.S.C. 154(b) by 34 days.

(21) Appl. No.: 10/430,392

(22) Filed: May 7, 2003

(65) Prior Publication Data

US 2004/0222884 A1 Nov. 11, 2004

(51) Int. Cl.[7] ..... G08B 19/00; G08B 17/10
(52) U.S. Cl. ..... 340/522; 340/628; 340/632
(58) Field of Search ..... 340/522, 539.26, 340/539.22, 632, 628, 630, 634; 73/202.5, 204.11, 204.23

(56) References Cited

U.S. PATENT DOCUMENTS 4,405,919 A * 9/1983 Scheidweiler ..... 340/522
4,688,183 A * 8/1987 Carll et al. ..... 700/275
5,005,003 A * 4/1991 Ryser et al. ..... 340/587
5,212,983 A * 5/1993 Ott et al. ..... 73/204.15
5,767,776 A * 6/1998 Wong ..... 340/632
6,215,405 B1 4/2001 Handley et al. ..... 340/584
6,229,439 B1 * 5/2001 Tice ..... 340/506
2002/0118116 A1 8/2002 Tice et al. ..... 340/632

FOREIGN PATENT DOCUMENTS

| | | |
|---|---|---|
| EP | 1 006 500 | 4/2001 |
| EP | 1 253 656 | 6/2001 |
| GB | 2 339 946 | 2/2000 |
| GB | 2 370 400 | 6/2002 |

* cited by examiner

*Primary Examiner*—Donnie L. Crosland
(74) *Attorney, Agent, or Firm*—Baker & Hostetler LLP

(57) ABSTRACT

A device with multiple sensors for detecting multiple alarm conditions coupled to a single control unit provides for monitoring and interrogating air flow through Heating/Ventilation/Air-conditioning (HVAC)-type ducts for changes to ambient conditions such as smoke, heat, gas, and/or relative humidity.

24 Claims, 3 Drawing Sheets

AMBIENT CONDITION DETECTOR WITH MULTIPE SENSORS AND SINGLE CONTROL UNIT

FIELD OF THE INVENTION

The present invention relates to the field of detecting changes to ambient conditions, for example by monitoring and assessing air flow conditions through Heating/Ventilation/Air-conditioning (HVAC)-type ducts and providing alarm indication when ambient conditions are compromised. More particularly, the present invention relates to a device with multiple sensors for detecting multiple alarm conditions coupled to a single control unit.

BACKGROUND OF THE INVENTION

Ambient condition detectors have been found to be useful in providing an indication of the presence or absence of the respective condition being detected. Smoke, gas, temperature, and relative humidity detectors, for example, have been found useful in providing early warnings of the presence of mechanical malfunction and/or fire.

When used in Heating/Ventilation/Air-conditioning (HVAC) duct systems, ambient condition detectors are able to not only signal the presence of alarm conditions anywhere in the building, but also in the machinery of the HVAC ducts themselves. Generally, detectors are placed in either the air-intake or return. When detectors are desired in both intake and return ducts, however, two separate units are installed in each individual duct. This method results in redundant use of circuitry which also adds to the cost of installation and service.

Therefore, there continues to be a need for solutions to monitor ambient air conditions in both air supply and air return ducts reducing redundant use of control or monitoring circuitry. It is also desirable to provide an air flow detection system and method that is able to sample the air flow through the detector and compare it to ambient air flow conditions and thereby signal restriction in air flow.

SUMMARY OF THE INVENTION

The foregoing needs are met, at least in part, by the present invention where, in one aspect, a device is provided for use in ambient condition having multiple sensors coupled to a single control unit. An integrated device for installation, for example, in HVAC ducts for detecting a dangerous condition is provided, comprising a first sensor to determine the presence of a first ambient condition, the first sensor providing a first alarm signal, a second sensor to determine the presence of a second alarm condition, the second sensor providing a second alarm signal, and a control unit, the control unit comprising a processor coupled to the first sensor and the second sensor, the control unit providing a status message indicative of the state of the first alarm signal and second alarm signal. The first detector may be a photoelectric smoke sensor or an ionization smoke sensor in some embodiments.

In other embodiments, the detector may have an air flow sensor and a processor to compare said air flow to a low air flow threshold, the processor providing an air flow alarm signal indicative of low air flow status when the air flow status is less than the low air flow threshold. The air flow threshold may be adjustable and/or set to ambient air flow.

In yet other embodiments, the detector may have a temperature sensor and a processor to compare the temperature to a high temperature threshold, the processor providing a temperature alarm signal indicative of high temperature when the temperature is greater than the temperature threshold. The temperature threshold may be adjustable and/or set to ambient air flow.

In yet still other embodiments, the detector may have a $CO_2$ sensor and a processor to compare the sensed $CO_2$ to a high $CO_2$ threshold, the processor providing a $CO_2$ alarm signal indicative of high $CO_2$ when the $CO_2$ present is greater than the $CO_2$ threshold. The $CO_2$ threshold may be adjustable and/or set to ambient air flow.

In other embodiments an integrated detection system is provided for installation in HVAC ducts for detecting a dangerous condition, comprising a first sensing means for determining a first ambient condition and for providing a first alarm signal, a second sensing means for determining the presence of a second ambient condition and for providing a second alarm signal, and a control means, the control means comprising a processing means coupled to the first sensing means and the second sensing means for providing a status message indicative of the state of the first alarm signal and second alarm signal. The first detector may be a photoelectric smoke sensor or an ionization smoke sensor in some embodiments.

In other embodiments, the detection means may have an air flow sensor and a processing means to compare the air flow to a low air flow threshold and for providing an air flow alarm signal indicative of low air flow status when the air flow status is less than the low air flow threshold. The air flow threshold may be adjustable and/or set to ambient air flow.

In yet other embodiments, the detection means may have a temperature sensor and a processor to compare the temperature to a high temperature threshold and for providing a temperature alarm signal indicative of high temperature when the temperature is greater than the temperature threshold. The temperature threshold may be adjustable and/or set to ambient air flow.

In yet still other embodiments, the detection means may have a $CO_2$ sensor and a processing means to compare the sensed $CO_2$ to a high $CO_2$ threshold and for providing a $CO_2$ alarm signal indicative of high $CO_2$ when the $CO_2$ present is greater than the $CO_2$ threshold. The $CO_2$ threshold may be adjustable and/or set to ambient air flow.

There has thus been outlined, rather broadly, several features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE INVENTION

Figure 1:
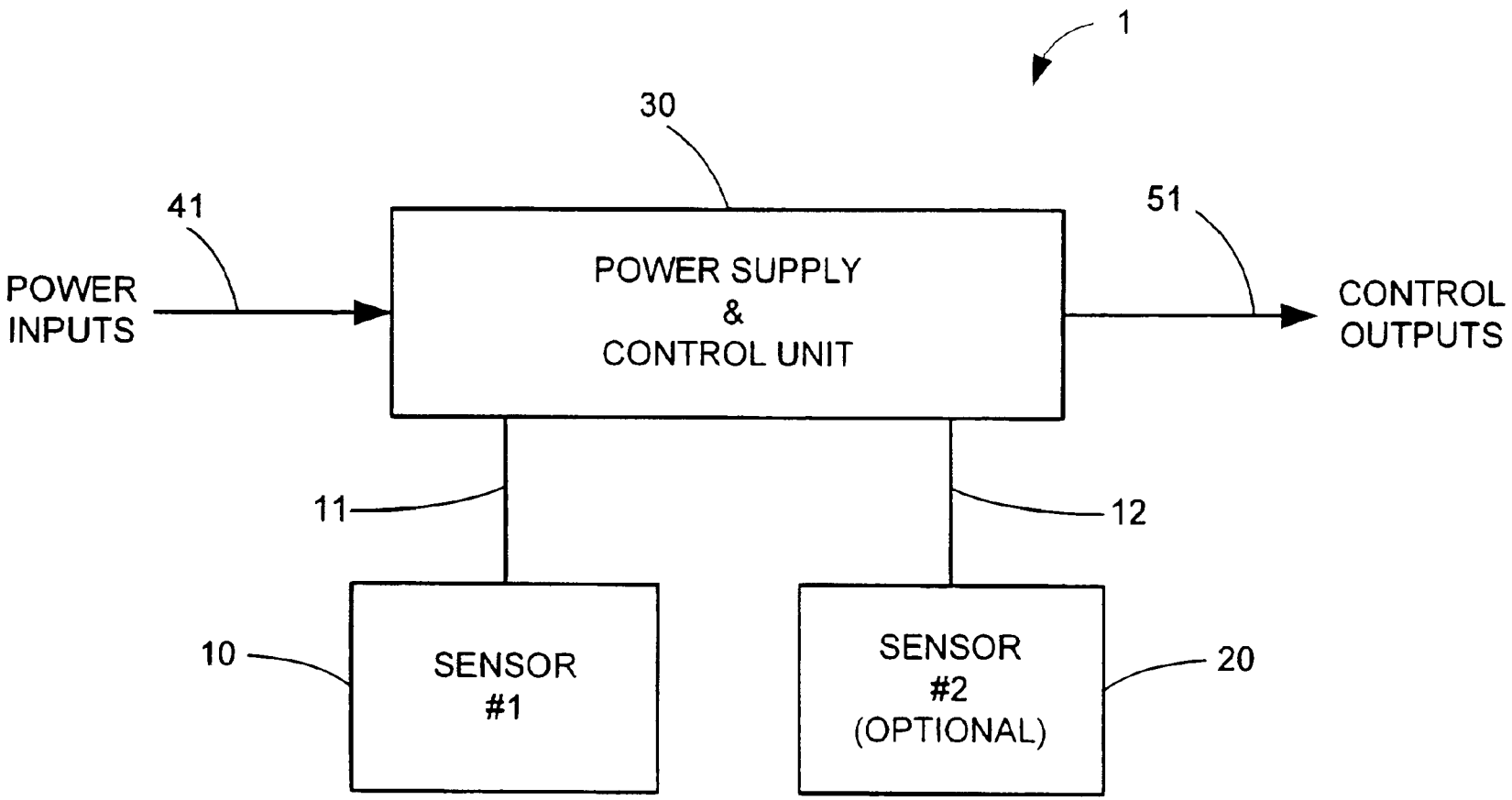
FIG. 1 is a block diagram of an embodiment of the present invention showing a detector with multiple sensors and a single control unit.

The invention in some embodiments provides a system and method for providing ambient condition detection having multiple sensors coupled to a single control unit. Preferred embodiments will now be described with reference to the drawing figures, in which like reference numerals refer to like parts throughout.

Referring to FIG. 1, an integrated detector 1 with sensors 10 and 20 and a single control unit 30 is shown. Additional sensors are integrated as desired with control unit 30. Many types of ambient condition sensors are known in the art such as smoke, gas, temperature, and relative humidity detectors, and can be used in embodiments of the invention.

In embodiments where smoke detectors are used, the sensors are preferably ionization-type or photoelectric. In the embodiment shown in FIG. 1, the sensors 10 and 20 relay signals 11 and 21, respectively, to the control unit 30. The sensors 10 and 20 will relay smoke alarm signals if they are smoke sensors, and/or heat alarm signals if they are heat sensors and/or gas alarm signals if they are gas sensors.

Figure 2:
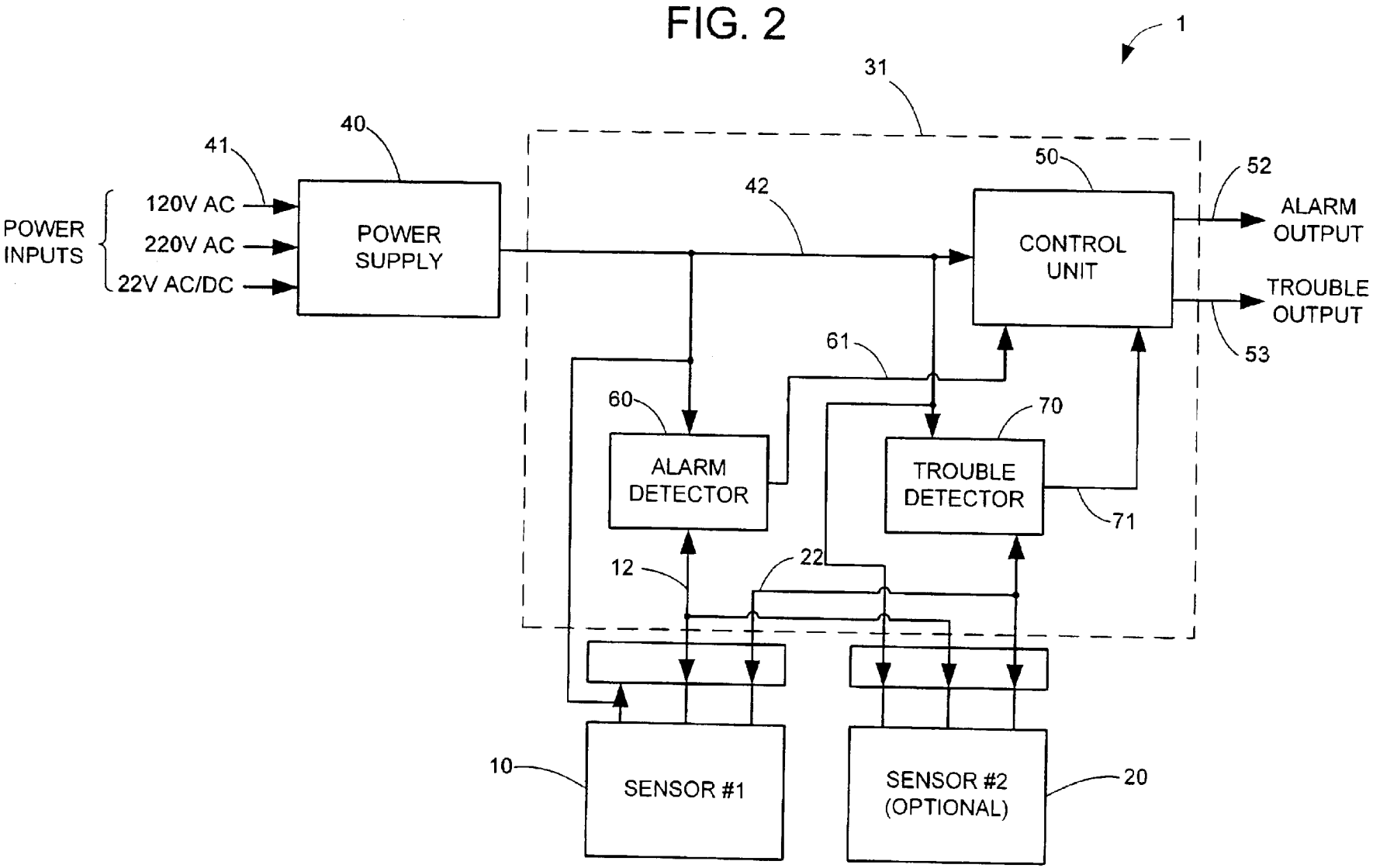
FIG. 2 is a block diagram of a power supply and control unit, including an alarm detector and a trouble detector.

The control unit 30 may comprise both a power supply and an output control as shown in FIG. 2. However, the power supply may be integral to the control unit 30 or coupled peripherally. In any case, the power supply is powered by power input 41. The power supply may power the control unit 30 and the sensors 10 and 20, or alternatively, the sensors 10 and 20 may be independently powered.

The control unit 30 may also include a processor to monitor aforementioned signals from the sensors 10 and 20. The control unit 30 assesses these signals along with other conditions such as power of the power source, and when a trouble condition is present, the control unit 30 sends a status message via a control output 51. The control output 51 may be transmitted though any of multiple transmission methods, including radio frequency, electronic transmission, and/or fiber optics. The control output 51 may include an audio signal.

FIG. 2 shows a greater detail view of control unit 31 and of power supply 40 of the detector embodied in FIG. 1. The detector 1 is shown comprising a power supply 40 and control unit 31. Alarm detector 60 and trouble detector 70 are individually coupled to output control 50. The alarm detector 60, trouble detector 70, and output control 50 are parts of control unit 31. A variety of power inputs 41 to power the power supply 40 are available and can be used, including 120V AC, 220V AC, and 24V AC/DC.

The power supply 40 may be equipped to receive the any one or all of the mentioned power inputs. Power output bus 42 may serve to power multiple devices within the detector 1, including the output control 50, the detectors 60 and 70, and individual sensors 10 and 20, as shown. Power output bus 42 may range from about 12V to about 24V DC, and preferably 18V DC in some embodiments.

Each sensor 10 and 20 coupled to the control unit 31 of the detector 1 may individually relay both an alarm signal and a trouble signal. The alarm sensor signal and trouble sensor signal from each of the sensors 10 and 20 are relayed via an alarm bus 12 and a trouble bus 22, respectively. Information from the alarm bus 12 is synthesized in the alarm detector 60 and the alarm detector signal 61 and is relayed to the output control 50. Similarly, information from the trouble bus 22 is synthesized in the trouble detector 70 and the trouble detector signal 71 is relayed to the output control 50. The output control 50 contains a microprocessor to evaluate and interpret the alarm detector signal 61 and the trouble detector signal 71. Thereupon, the output control 50 relays the appropriate alarm output 52 and trouble output 53.

Figure 3:
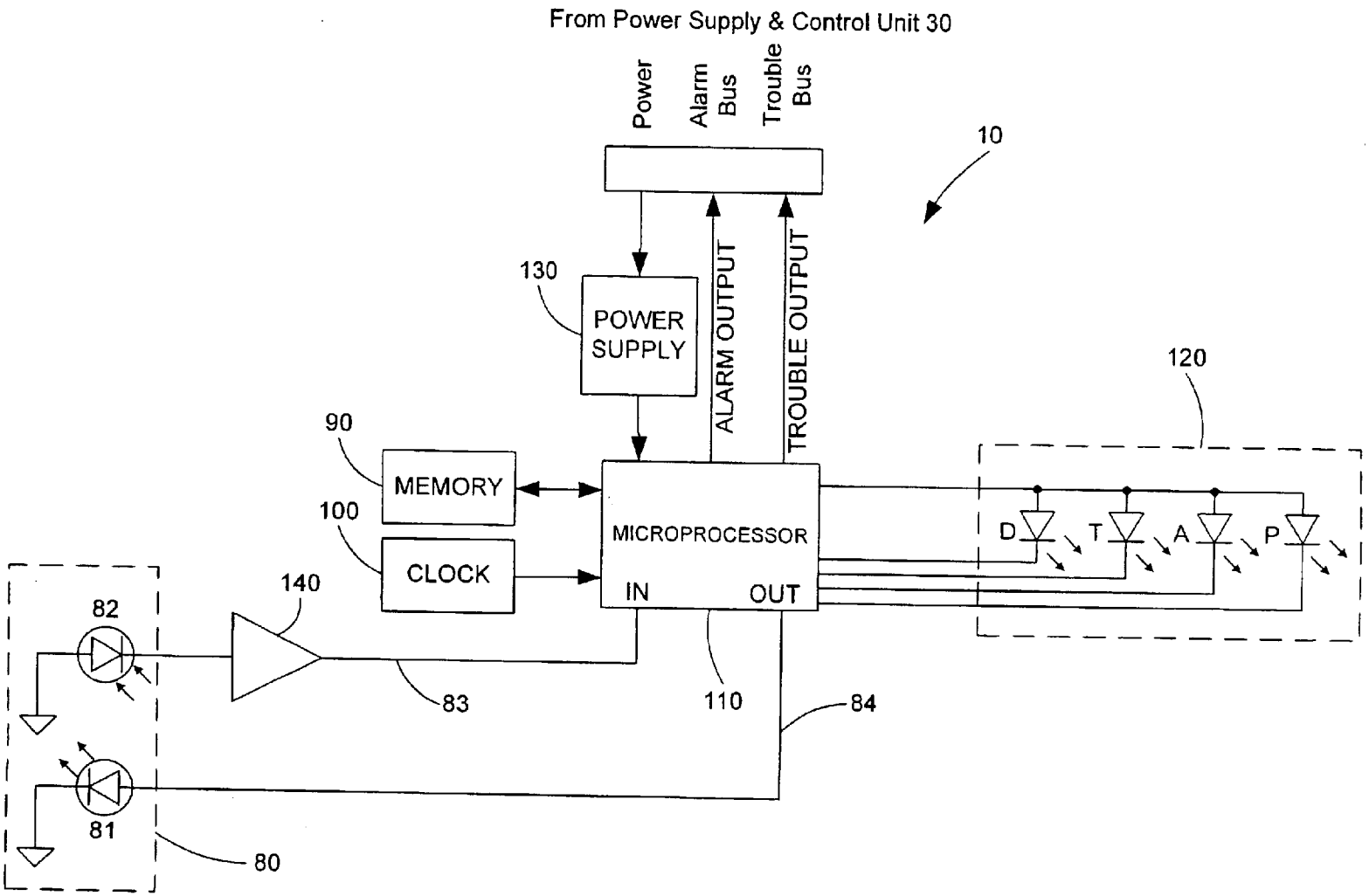
FIG. 3 is a block diagram of a sensor.

FIG. 3 shows a detail of sensor unit 10 of a detector 1 of the instant invention. In the embodiment shown, sensor 10 is a smoke sensor, however, as mentioned, sensors of this invention are not limited to smoke sensors. Sensor 10 includes a smoke sensing chamber 80, a memory 90, a clock 100, a microprocessor 110, status lights 120, a power supply 130, and an amplifier 140.

The smoke sensing chamber 80 comprises an infrared (IR) light-emitting diode (LED) transmitter 81 and a photo diode receiver 82. The transmitter 81 and receiver 82 are generally positioned at 90-degree angles to one another. In the absence of smoke then, the light from transmitter 81 bypasses receiver 82. When smoke enters the chamber 80, however, the smoke particles scatter light from transmitter 81 and some amount of light is detected by receiver 82. The signal 83 from the receiver diode 82 is further amplified by an amplifier 140 en route to the microprocessor 110.

The microprocessor 110 may be calibrated to monitor changes in the signal 83 compared to a transmitter signal 84 that is relayed to IR LED transmitter 81. A microprocessor clock 100 may be integral or peripheral to microprocessor chip 110. As with the clock 100, memory 90 may also be integral or peripheral to the microprocessor chip 110. The status lights 120 may be LEDs to signal to the operator conditions such as, for example, trouble, alarm, and/or power status of sensor 10. Likewise, if the sensor is equipped with a filter to remove large particulate matter from the air flow though smoke sensing chamber 80, then an LED for the dirt status of the filter may also be included on status light display 120.

The status light display 120 may be comprised of a series of LEDs. The LEDs may signal proper function or the indication of an alarm condition when visible light is present. Alternatively, the detector may be designed such that proper function or indication of alarm condition is indicated by the lack of visible light. A combination of light signaling can also be implemented.

The microprocessor 110 is supplied power through a power supply 130. The power source, alarm output, and trouble output, are each coupled to power bus 42, alarm bus 12, and trouble bus 22, respectively.

The microprocessors of this invention may be equipped to determine not only the presence or absence of the condition being sensed, but also the status level of the condition being sensed relative to a baseline or threshold value. In other words, a microprocessor of a temperature sensor in some embodiments may be calibrated to not only read the temperature level, but also be able to compare the temperature to a preset threshold. Such a threshold may be adjustable or may be set to ambient temperature. As the temperature of certain buildings may be preset to rise or fall at certain set cycles, so too are microprocessors of the present invention preferably embodied to take the ambient rise and fall in temperature into account when signaling an alarm condition. The same process described above for temperature sensors may also be similarly applied to $CO_2$, smoke, and/or relative humidity sensors.

In some embodiments, an air flow sensor is also incorporated. Particularly with ambient air condition detectors where filters are placed internally to remove unwanted particulate matter from initiating false alarm signals, air flow can often become compromised when the filters get contaminated. Alternatively, where airflow is deliberately reduced at certain periods of the day, air flow through the sensor can also be reduced.

In either event, it is desirable to provide a microprocessor that is able to distinguish restrictions in air flow from air filter contamination from restrictions in air flow from preset reduction in air circulation through out the building. Many devices for detecting and comparing air flow are known and available in the art, including the use of thermistors.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A device for detecting an ambient condition, comprising:

a first sensor to determine the presence of a first ambient condition, said first sensor providing a first alarm signal;

a second sensor to determine the presence of a second ambient condition, said second sensor providing a second alarm signal; and a control unit comprising a processor coupled to said first sensor and said second sensor, said control unit providing a status message indicative of the state of said first alarm signal and second alarm signal, wherein the status message comprises a status light display having LED signaling for indicating trouble, alarm and/or power status and wherein at least one of said first and second sensors is adapted for location in a HVAC duct.

2. A device of claim 1, wherein said first sensor is a photoelectric smoke sensor having a smoke sensing chamber.

3. A device of claim 1, wherein said first sensor is an ionization-type smoke sensor having a memory device.

4. A device of claim 1, wherein said first sensor comprises an air flow sensor to determine air flow through the first sensor, said air flow sensor providing an air flow alarm signal.

5. A device of claim 4, wherein said first sensor further campuses a processor to compare said air flow to a low air flow threshold, said processor providing an air flow alarm signal indicative of low air flow status when said air flow status is less than said low air flow threshold.

6. A device of claim 5, wherein said low air flow threshold is adjustable.

7. A device of claim 6, wherein said low air flow threshold is ambient air flow.

8. A device of claim 4, wherein said air flow sensor comprises a thermistor.

9. A device of claim 1, wherein said second sensor is a temperature sensor to determine temperature level in the second sensor, said temperature sensor providing a temperature alarm signal.

10. A device of claim 9, wherein said temperature sensor further comprises a processor to compare said temperature level to a high temperature threshold, said processor providing a temperature alarm signal indicative of a high temperature level when said temperature level is higher than said high temperature threshold.

11. A device of claim 10, wherein said high temperature threshold is adjustable.

12. A device of claim 11, wherein said high temperature threshold is ambient temperature.

13. A device of claim 9, wherein said temperature sensor comprises a thermistor.

14. A device of claim 1, wherein said second sensor is a $CO_2$ sensor to determine $CO_2$ level in the second sensor, said $CO_2$ sensor providing a $CO_2$ alarm signal.

15. A device of claim 14, wherein said $CO_2$ sensor further comprises a processor to compare said $CO_2$ level to a high $CO_2$ threshold, said processor providing a $CO_2$ alarm signal indicative of a high $CO_2$ level when said $CO_2$ level is higher than said high $CO_2$ threshold.

16. A device of claim 15, wherein said high $CO_2$ threshold is adjustable.

17. A device of claim 16, wherein said high $CO_2$ threshold is the ambient temperature.

18. A device of claim 1, wherein said second sensor is a second smoke sensor.

19. A device of claim 1, wherein said second sensor is a relative humidity sensor.

20. An integrated detection system for detecting ambient conditions, comprising:

first sensing means for determining the presence of a first ambient condition and for providing a first alarm signal;

second sensing means for determining the presence of a second ambient condition and for providing a second alarm signal; and control means, comprising a processing means coupled to said first sensing means and said second sensing means for providing a status message indicative of the state of said smoke alarm signal and second alarm signal, wherein at least one of said first and second sensing means is adapted for location in a HVAC duct and wherein the status message comprises status light display having LED signaling for indicating trouble, alarm and/or power status.

21. An integrated detection system of claim 20, wherein said first sensing means is a photoelectric smoke sensor having a smoke sensing chamber.

22. An integrated detection system of claim 20, wherein said first smoke sensing means is an ionization-type smoke sensor having a memory device.

23. A method of using an integrated device for detecting ambient conditions, comprising the steps of:

sensing the presence of a first ambient condition and providing a first alarm signal;

sensing the presence of a second ambient condition and proving a second alarm signal;

processing said first alarm signal and said second alarm signal; and providing a status message indicative of the state of said first alarm signal and second alarm signal, wherein the status message comprises a status light display having LED signaling for indicating trouble, alarm and/or power status.

24. A method of claim 23, wherein the first ambient condition is a smoke condition.

* * * * *

UNITED STATES PATENT AND TRADEMARK OFFICE

CERTIFICATE OF CORRECTION

PATENT NO. : 6,897,774 B2
DATED : May 24, 2005
INVENTOR(S) : Hilario Costa et al.

It is certified that error appears in the above-identified patent and that said Letters Patent is hereby corrected as shown below:

Title page,
Item [54], Title, please replace "MULTIPE SENSORS AND SINGLE" with -- MULTIPLE SENSORS AND SINGLE --.

Column 5,
Line 50, please replace "campuses a processor to compare said air flow to a low air" with -- comprises a processor to compare said air flow to a low air --.

Signed and Sealed this

Sixteenth Day of August, 2005

JON W. DUDAS
*Director of the United States Patent and Trademark Office*